US005340023A

United States Patent [19]

Itoh et al.

[11] Patent Number: 5,340,023

[45] Date of Patent: Aug. 23, 1994

[54] PLASMA SPRAYING METHOD AND APPARATUS

[75] Inventors: Tsutomu Itoh, Tokyo; Shinji Fukami, Tokorozawa; Masayuki Kitoh, Tokyo, all of Japan

[73] Assignee: Onoda Cement Company, Ltd., Yamaguchi, Japan

[21] Appl. No.: 934,929

[22] Filed: Aug. 25, 1992

[30] Foreign Application Priority Data

Aug. 26, 1991 [JP] Japan ..... 3-238648

[51] Int. Cl.[5] ..... C23C 4/00

[52] U.S. Cl. ..... 239/13; 239/79; 239/81; 219/121.47; 219/76.16; 427/446

[58] Field of Search ..... 239/1, 13, 8, 79, 81; 219/121.47, 76.16; 427/446, 453

[56] References Cited

U.S. PATENT DOCUMENTS 4,741,286 5/1988 Itoh et al. ..... 239/81

*Primary Examiner*—Karen B. Merritt

*Attorney, Agent, or Firm*—Price, Heneveld, Cooper, DeWitt & Litton

[57] ABSTRACT

A plasma flame flowing to a substrate around a beam of melt droplets is trimmed by spraying a refrigerant on the periphery of the plasma flame in the direction which allows the refrigerant to contact with the beam of the melt droplets.

9 Claims, 5 Drawing Sheets

PLASMA SPRAYING METHOD AND APPARATUS

BACKGROUND OF THE INVENTION

The present invention relates to a plasma spraying method and apparatus for obtaining a sprayed film having abrasion resistance and corrosion resistance or a film of a ceramic solid electrolyte or the like required to have high functionality, and a sprayed film obtained by the method.

In this type of previous invention, as shown in FIG. 4, a granular spraying material 56 is supplied to a portion close to an anode 53 of a plasma torch 51 through a material supply nozzle 55 to form high-temperature fine-grain melt droplets 57 which are conveyed and accelerated by a plasma flame 54 discharged from an outlet 58 of the plasma torch 51 and which are caused to collide with a substrate 59 placed in front of the plasma flame 54 to form a sprayed film 60 of the spraying material on a surface of the substrate.

In this case, the plasma flame 54 is enlarged to the shape shown in the drawing due to the attraction of surrounding air 61 in the space ranging from the outlet of the plasma torch 51 to the substrate 59. The heat history of the melt droplets 57 in the plasma flame 54 is widely changed by the course. This deteriorates the uniformity of the sprayed film 60 formed on the surface of the substrate 59 and decreases the density thereof.

In order to solve the above problem, a plasma spraying apparatus as shown in FIG. 5 is proposed in which the length from the tip 62 of a cathode 52 of a plasma torch 51 to the anode point 63 of an anode 53 is longer than that shown in FIG. 4, and an annular gas passage 65 is concentrically provided outside a plasma gas passage 64 provided around the cathode 52. Tangential passages 67 are also formed in an annular ring wall 66 between both gas passages 64, 65 so that plasma gas 69 introduced from a plasma gas inlet 68 is caused to flow to the outlet 58 while being circulated by the plasma gas passage 64 around the cathode 52. The gas is thus sufficiently heated by a relatively long arc 50 produced between the cathode tip 62 and the anode point 63 to form an elongated plasma flame 54, whereby the focusing and stability of a beam of the melt droplets 57 contained in the flame 54 can be improved.

However, if the length L6 of the plasma flame 54 is sufficiently longer than the length L5 of the plasma flame 54 shown in FIG. 4, as described above, when the droplets of the spraying material collide with the substrate 59, there is the danger that the plasma flame 54 for conveying the droplets also collides with the substrate 59 and thus damages it due to overheating.

In order to prevent the substrate from being damaged by the elongated plasma flame 54, it is thought that the substrate 59 is disposed far away from the outlet 58 of the plasma torch 51 in the plasma flame 54 so that the temperature of the plasma flame 54 is decreased by air 61 in the space between the outlet 58 of the plasma torch 51 and the substrate 59.

However, this method decreases the speed of the droplets 57 at the time of collision with the substrate 59 and decreases the denseness and adhesion of the sprayed film 60 formed by cooling the melt droplets 57. Namely, conditions of the length L5, L6 which are required for preventing the damage of the substrate 59 and for improving the quality of the sprayed film 60 contradict each other. It is difficult to satisfy the both conditions.

SUMMARY OF THE INVENTION

It is an object of the present invention to prevent a plasma flame for conveying droplets of a spraying material from colliding with a substrate and from damaging the substrate due to overheating when the droplets collide with the substrate, and to cause the high-temperature droplets at the center of the plasma flame to collide with the substrate without cooling the droplets.

It is another object of the present invention to obtain a high-quality sprayed film having high denseness, abrasion resistance and so on.

In one aspect of the present invention, there is provided a plasma spraying method comprising spraying a refrigerant on a plasma flame flowing around a beam of melt droplets of a spraying material, which is generated between a material supply portion of a plasma torch and a substrate placed in front of the plasma torch, in the direction which allows the refrigerant to contact with the plasma flame flowing around the beam of melt droplets.

In another aspect of the present invention, there is provided a plasma spraying apparatus comprising refrigerant nozzles which are provided in a plasma flame passage placed around the passage of the melt droplets in the direction which allows spray from the nozzles to contact with the passage of the plasma flame flowing around the melt droplets of the spraying material.

In a further aspect of the present invention, there is provided a sprayed film formed by spraying a refrigerant on the plasma flame which flows around a beam of the melt droplets so as to trim the plasma flame in the direction which allows the refrigerant to contact with the plasma flame around the melt droplets, and by causing the melt droplets to collide with a substrate.

The refrigerant is sprayed on the plasma flame flowing around the beam of the melt droplets of the spraying material, which is generated between the material supply portion of the plasma torch and the substrate placed in front the plasma torch, in the direction which allows the refrigerant to contact with the plasma flame around the melt droplets, thereby cooling the plasma flame alone without cooling the beam of the melt droplets.

As a result, the beam of the melt droplets is not cooled and collides with the substrate as it is at a high temperature. At the same time, the plasma flame which flows around the melt droplets is trimmed and does not collide with the substrate. This prevents the damage of the substrate.

These and other features, objects and advantages of the invention will be apparent upon reading the following description and referring to the accompanying drawings, in which:

DESCRIPTION OF PREFERRED EMBODIMENTS OF THE INVENTION

Figure 1:
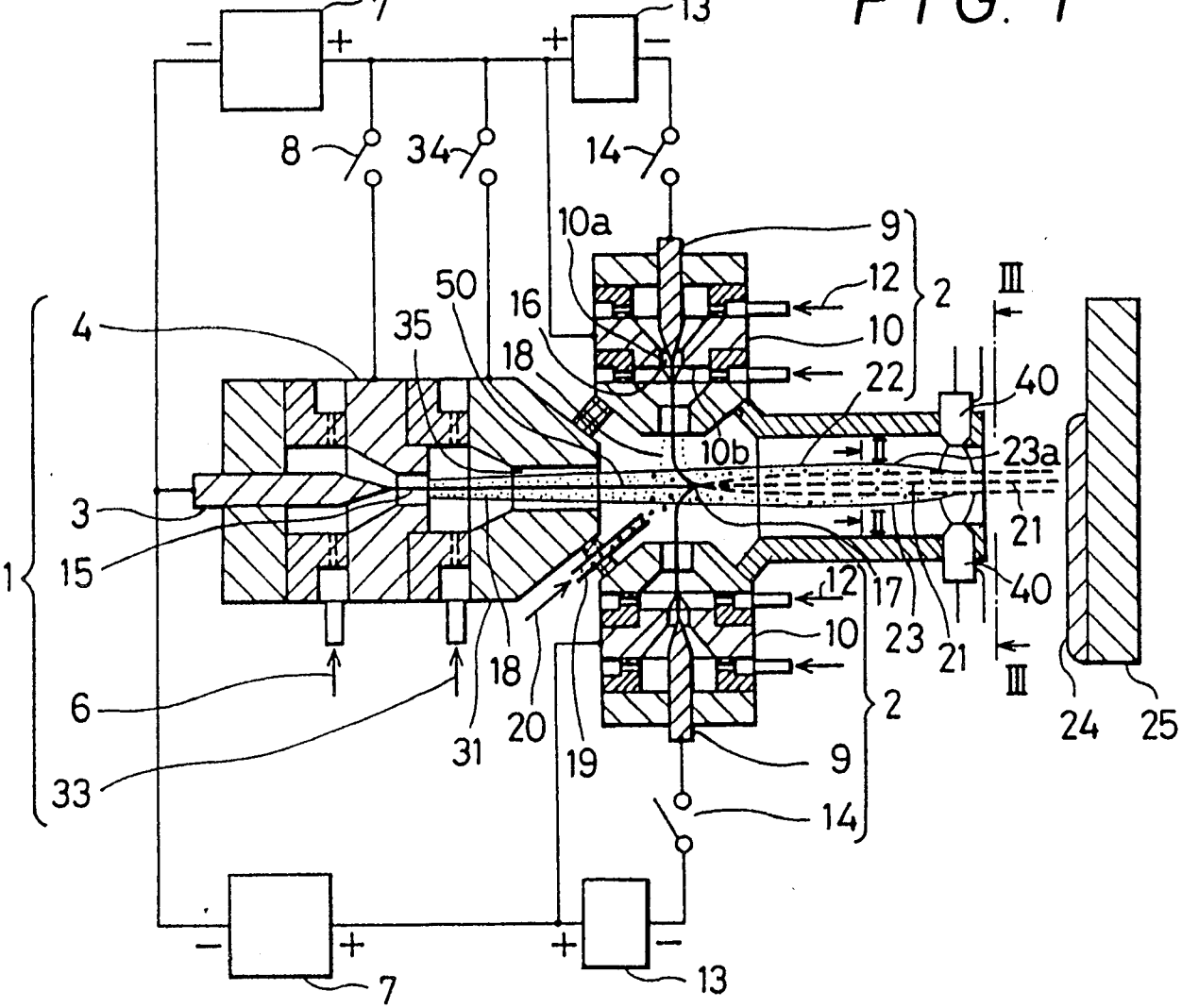
FIG. 1 is a longitudinally sectional view showing a plasma spraying method and apparatus and the sprayed film formed by the method in accordance with an embodiment of the present invention.
Figure 3:
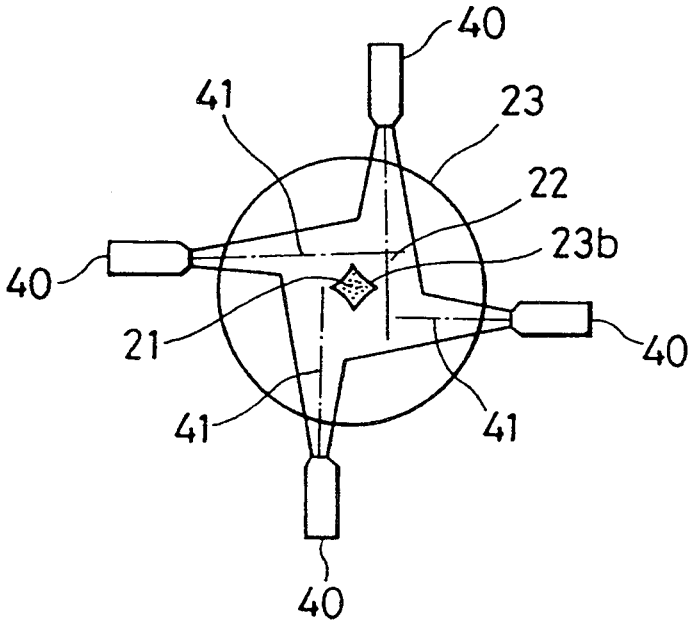
FIG. 3 is a drawing of the portion of line III—III shown in FIG. 1 as viewed from the arrows.

In an embodiment of a plasma spraying method of the present invention, as shown in FIG. 1, a refrigerant is sprayed from refrigerant nozzles 40 on a plasma flame 23 which flows in the same direction around a beam of the melt droplets 21 of a spraying material 20 generated between a spraying material supply portion 19 of a main torch 1 and a substrate 25 placed in front of an outer casing in the direction which allows the refrigerant to contact with the plasma flame around the melt droplets 21, as shown in FIGS. 1 and 3.

The plasma spraying apparatus of this embodiment of the present invention is started according to the following procedure:

A switch 8 is first closed so that a main starting arc 15 is formed between a main cathode 3 and a discharge portion of a main outer casing 4 by a main power source 7. A protective gas is thus heated, and a conductive plasma is discharged from the tip of the main outer casing 4.

At this time, when switch means 34 is closed, and switch means 8 is then opened, the main starting arc 15 is eliminated, and at the same time, the arc discharged from the tip of the main cathode 3 forms a main second outer casing starting arc 35. The protective gas 6 and main plasma gas 33 are thus heated to form a conductive plasma 50 and a plasma flame 23 which are discharged to the outside of the main torch 1.

When switch means 14 is then closed so that a subsidiary starting arc 16 is formed between a subsidiary first outer casing 10 and a subsidiary starting electrode 9 by a subsidiary power source 13, subsidiary gas 12 is heated by the arc formed, and a conductive plasma 18 is discharged from the discharge port of the subsidiary first outer casing 10 to the outside of a subsidiary torch 2 through a narrow port of a subsidiary second outer casing.

When the above process is completed, the conductive plasmas 50, 18 discharged from the main torch 1 and the subsidiary torch 2, respectively, form a conduction passage because the main torch 1 and the subsidiary torch 2 are disposed so that the axes thereof cross each other. In this step, when the switch means 34 and 14 are opened, a stationary hair pin arc 17 is formed from the tip of the main cathode 3 to the outer surface **10*b* of the narrow port 10*a* of the subsidiary outer casing 10 by the main power source 7**.

At this time, a plasma flame 23 substantially concentric with the axis of the main torch 1 is formed by adjusting each of the amount of the gas introduced into the main torch 1 and the amount of the gas sent to the subsidiary torch 2, as shown in FIG. 1.

Figure 9:
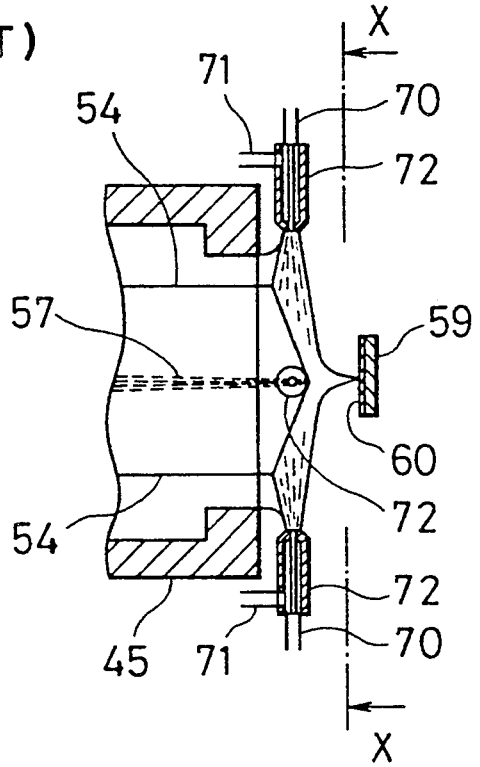
FIG. 9 (PRIOR ART)
FIG. 9 is a longitudinally sectional view of another plasma spraying apparatus.

In this embodiment, the plasma in the peripheral portion **23*a* of the plasma flame 23 on the upstream side of the refrigerant nozzles 40, which is shown in FIGS. 1 and 9, is trimmed by the refrigerant from the refrigerant nozzles 40, thereby significantly decreasing the thermal load on the substrate 25 and decreasing the spraying distance. As a result, a dense and high quality sprayed film 24 can be obtained. On the other hand, the plasma in the central portion 23*b* of the plasma flame 23 is not trimmed by the refrigerant and thus functions to keep the melt droplets 21** in a melt state.

Since this embodiment are provided the above characteristics, a dense and high quality film can be obtained. This is described below with reference to FIG. 3.

A plurality of refrigerant nozzles 40 such as atomizer binary-fluid nozzles or the like for supplying as a refrigerant water and air to the passage 22 of the plasma flame 23 are disposed in such a manner that the direction of the spray axis 41 of each of the refrigerant nozzles 40 toward the peripheral portion **23*a* of the plasma flame 23 is deviated from the central portion thereof. The fine refrigerant 40 is sprayed on the peripheral portion 23*a* of the plasma flame 23 from each of the refrigerant nozzles 40 so as to separate the plasma in the peripheral portion 23*a* from the plasma flame 23 and prevent the refrigerant from concentrating in the central portion 23*b*. This causes the collision of the melt droplets 21 with the substrate 25** without decreasing the speed and temperature, thereby forming a dense sprayed film having a uniform thickness.

Although, in this embodiment, binary fluid nozzles are used as the refrigerant nozzles 40, single fluid nozzles can also be used. The spray discharged from each of the refrigerant nozzles 40 may have any desired shape such as a cone, a sector or the like according to demand.

Although water is suitable as the liquid sprayed from the refrigerant nozzles 40 in view of the latent heat of vaporization, ease of handling, no emission of toxic substances and the like, other fluids may be used according to demand.

In addition, although compressed air may be used as the driving gas for the binary fluid nozzles, $N_2$, Ar, He, $H_2$ or the like or a mixture thereof may be used according to demand and the type of the spraying material used.

Figure 2:
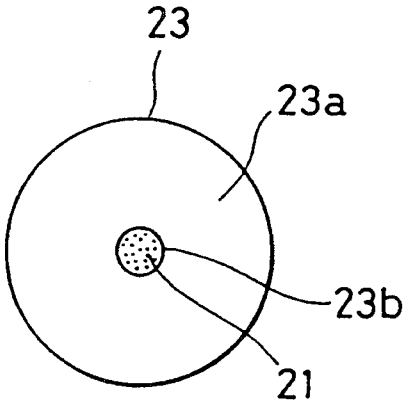
FIG. 2 is a sectional view taken along line II—II in FIG. 1.

An experiment example in which experiment of plasma spraying was performed by using the plasma spraying apparatus shown in FIGS. 1 to 3 is described below.

The nozzle outlet of each of the refrigerant nozzles 40 was disposed 15 mm downstream from the outlet of the plasma flame, arid water at 200 cc/min was sprayed so as to contact the periphery of the plasma spray including a beam of the droplets 20 discharged at the center of the plasma flame 23. The substrate 25 was placed in front of the material supply portion 19 at a distance of 90 mm therefrom. When the surface temperature of the substrate 25 was measured by a thermocouple during spray of yttria stabilized zirconia (YSZ), the temperature was 150° C. to 250° C.

Figure 7:
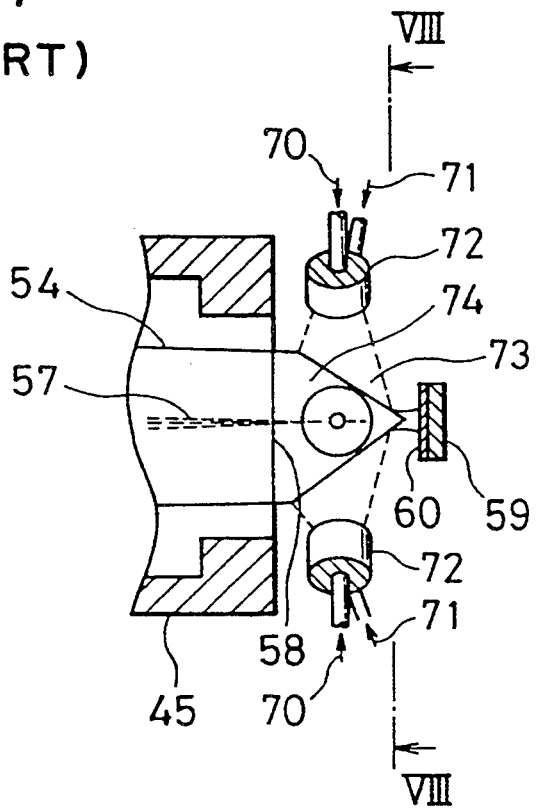
FIG. 7 (PRIOR ART)
FIG. 7 is a longitudinally sectional view of another plasma spraying apparatus.
Figure 8:
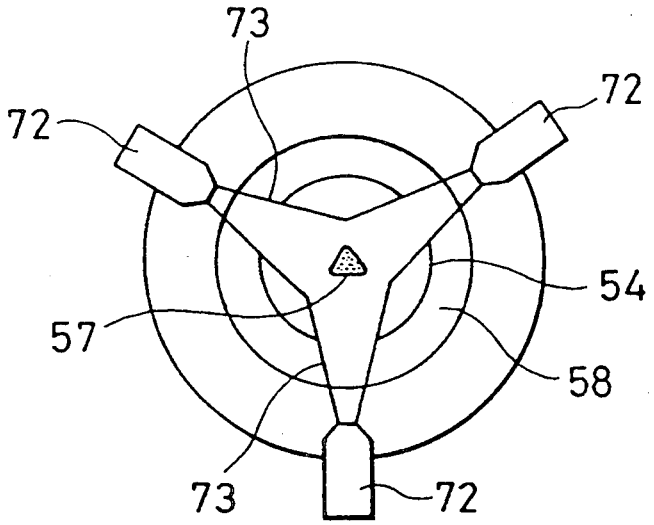
FIG. 8 (PRIOR ART)
FIG. 8 is a longitudinally sectional view taken along line VIII—VIII in FIG. 7.

This temperature was lower than the surface temperature of 250° C. to 300° C. which was measured by the same experiment as that described above with the exception that the atomizers 72 were disposed so that each of the axes thereof coincide with the axis of the plasma flame 54, as shown in FIGS. 7 and 8. It is thus possible to form films of various spraying materials even on a concrete substrate or the like, which has low thermal-shock breaking resistance, a plastic substrate or the like, which is easily deformed and deteriorated by heat, with minimizing the damage of the substrate used according to application.

Figure 4:
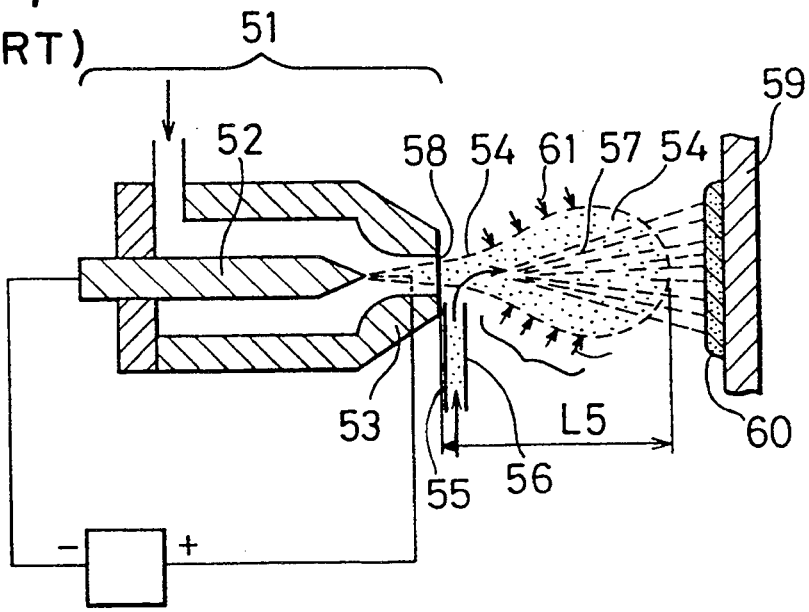
FIG. 4 (PRIOR ART)
FIG. 4 is a longitudinally sectional view of prior art.
Figure 5:
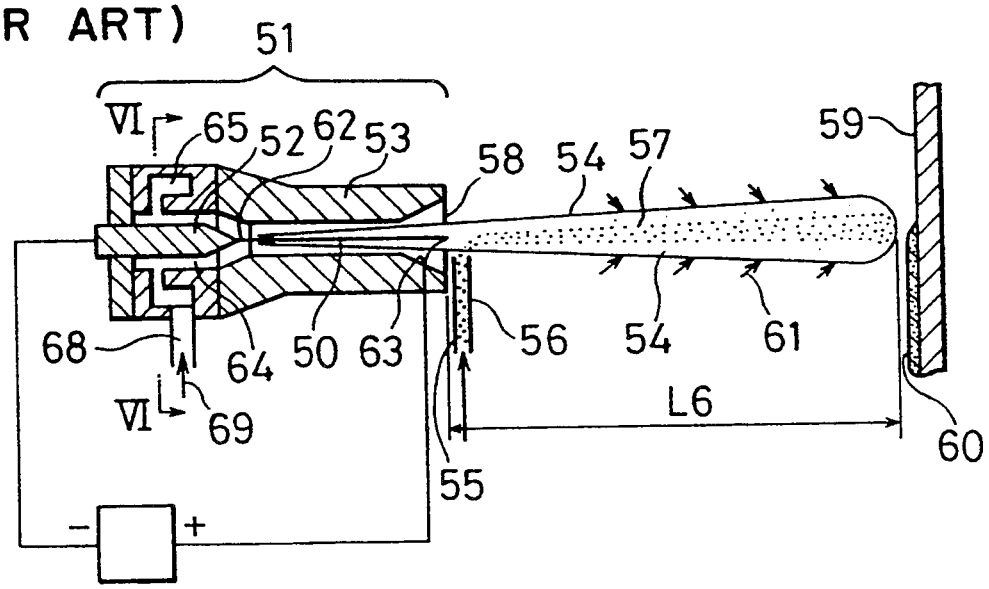
FIG. 5 (PRIOR ART)
FIG. 5 is a longitudinally sectional view of another prior art.
Figure 6:
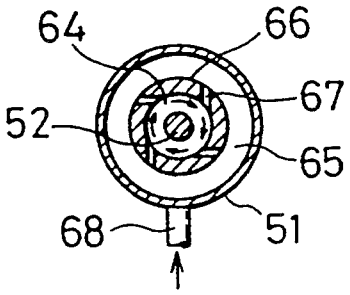
FIG. 6 (PRIOR ART)
FIG. 6 is a longitudinally sectional view taken along line VI—VI in FIG. 5.

The solid electrolyte sprayed film for fuel cell use, which was formed by the embodiment shown in FIGS. 1 to 3 had a nitrogen gas permeability of $7\times10^{-7}$ $cm^4/g.s$ which represents the denseness thereof. The value of nitrogen gas permeability was 1/10 of that of the YSZ sprayed film obtained by atmospheric plasma spraying using the apparatus shown in FIGS. 4 and 5. This shows that the film obtained by the embodiment shown in FIGS. 1 to 3 has extremely high denseness.

Figure 10:
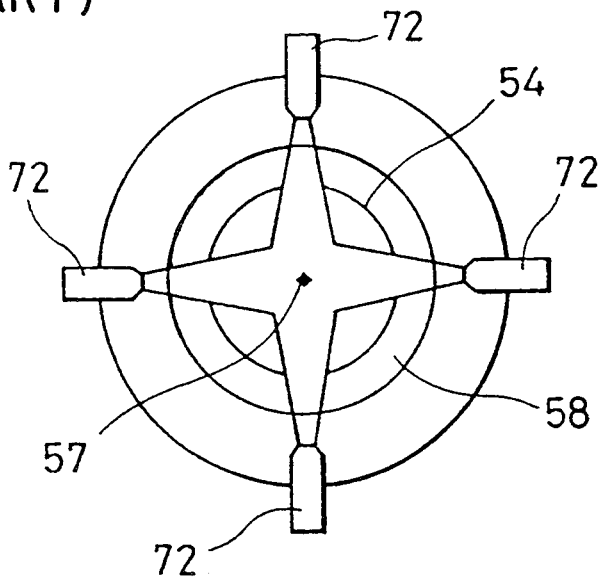
FIG. 10 (PRIOR ART)
FIG. 10 is a sectional view taken along line X—X in FIG. 9.

The inventors of this application invented the spraying apparatus shown in FIGS. 7 and 8 for which they filed an application in Japan. The apparatus of FIGS. 7 and 8 includes three or four atomizer binary-fluid nozzles 72 which cross each other are provided so as to supply water 70 and air 71 to a passage 74 of the plasma flame 54 near the outlet of an outer casing 45 of the plasma flame 54. Waterdrops are sprayed on the plasma flame 54 from the binary-fluid nozzles 72 so as to separate an excessive portion at the tip of the plasma flame 54 and cause the plasma flame 54 to collide with the substrate 59 without decreasing the speed and temperature of the melt droplets 57 to form a sprayed film 60 having a uniform thickness (Japanese Patent Application Hei 2-416650). The apparatus as shown in FIGS. 9 and 10, has the same function as the apparatus shown in FIGS. 7 and 8, it is not described below.

This apparatus can prevent the damage of the substrate and a decrease in the denseness of the sprayed film. However, since the binary-fluid nozzles 72 are disposed so that the axes thereof coincide with the passage 74 of the plasma flame 54, as shown in the drawings, the spray 73 from the binary-fluid nozzles 72 collides with the melt droplets 57 which are concentrated in the center axis of the plasma flame 54 when the excessive portion at the tip of the plasma flame 54 is separated. This causes cooling of the melt droplets 57 and thus causes the danger of decreasing the denseness of the sprayed film 60 formed on the substrate 59.

As described above, the present invention shown in FIGS. 1–3 prevents the substrate from being damaged by the high temperature plasma flame and thus permits the formation of a high quality sprayed film having high denseness, adhesion, uniformity and the like.

The present invention also enables trimming of only the excessive peripheral portion of the plasma flame with keeping away from the melt droplets which flow in the central portion of the plasma flame, thereby preventing the melt droplets from being cooled short the substrate to make a densely sprayed film.

What is claimed is:

1. A method of plasma spraying comprising the step of spraying a liquid refrigerant through spray nozzles onto a plasma spray including a plasma flame flowing around a beam of melt droplets of a spraying material said liquid refrigerant spray from said nozzles being directed toward the peripheral portion of the plasma spray such that said liquid refrigerant spray is deviated form the central portion of the plasma spray, allowing the passage of said beam of melt droplets, said plasma flame being generated between a spraying material supply portion of a plasma torch and a substrate placed in front of said plasma torch, so that said liquid refrigerant contacts the periphery of said plasma spray surrounding said beam of said melt droplets before said plasma spray contacts said substrate.

2. A plasma spraying method according to claim 1, wherein the step of spraying liquid refrigerant comprises spraying fine droplets from an atomizer.

3. The plasma spraying method as defined in claim 1, wherein said step of spraying a liquid refrigerant includes spraying water.

4. A plasma spraying apparatus comprising:

a flame spraying supply portion of a plasma torch generating a flame spray including melt droplets in a plasma flame;

refrigerant nozzles provided around a passage for said flame spray between said spraying supply portion and a substrate placed in front of the plasma torch; and a source of liquid refrigerant coupled to said nozzles and supplying liquid refrigerant to said nozzles, wherein said nozzles generate a liquid refrigerant spray in a direction such that said liquid refrigerant spray from said nozzles peripherally contacts said flame spray to reduce the cross-sectional area of said flame spray whereby a concentration of said melt droplets of said plasma spray contacts said substrate.

5. A plasma spraying apparatus according to claim 4, wherein each of said refrigerant nozzles is an atomizer which can spray fine droplets.

6. The apparatus as defined in claim 4, wherein said liquid refrigerant includes water.

7. A method of plasma spraying using a plasma torch comprising the steps of:

forming a plasma spray, including a plasma flame around a beam of melt droplets, between a spraying material supply portion of the plasma torch and a substrate positioned in front of the torch; and spraying a liquid refrigerant onto the periphery of the plasma spray around the beam of melt droplets such that said liquid refrigerant contacts said plasma flame and said melt droplets pass to the substrate without being cooled.

8. A method of plasma spraying, comprising the steps of:

forming a plasma spray including a plasma flame around a beam of melt droplets between a spraying material supply portion of a plasma torch and a substrate positioned in front of the torch; and spraying a liquid refrigerant onto the plasma flame such that the liquid refrigerant contacts the plasma flame around the melt droplets before the melt droplets contact the substrate.

9. The method as defined in claim 8, wherein said step of spraying a liquid refrigerant includes spraying water.

* * * * *